US005866982A

United States Patent [19]

Scott et al.

[11] Patent Number: 5,866,982

[45] **Date of Patent: *Feb. 2, 1999**

[54] ARCTUBE FOR HIGH PRESSURE DISCHARGE LAMP

[75] Inventors: Curtis E. Scott, Mentor, Ohio; Charles D. Greskovich, Schenectady, N.Y.; Mark E. Duffy, Shaker Heights, Ohio; George Eric Coxon, Leicester, United Kingdom

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 593,207

[22] Filed: Jan. 29, 1996

[51] Int. Cl.[6] ..... H01J 61/30

[52] U.S. Cl. ..... 313/634; 313/493; 313/573; 313/623

[58] Field of Search ..... 313/493, 573, 313/634, 623, 624, 625

[56] References Cited

U.S. PATENT DOCUMENTS

| | | |
|---|---|---|
| 3,363,133 | 1/1968 | Harris et al. . |
| 4,076,991 | 2/1978 | Datta . |
| 4,208,605 | 6/1980 | McVey et al. . |
| 4,409,517 | 10/1983 | Fan Der Sande et al. . |
| 4,766,347 | 8/1988 | Janssen et al. . |
| 4,780,646 | 10/1988 | Lange . |
| 5,140,227 | 8/1992 | Dakin et al. . |
| 5,321,335 | 6/1994 | Klug et al. . |
| 5,352,952 | 10/1994 | Juengst . |
| 5,484,315 | 1/1996 | Juengst et al. . |

FOREIGN PATENT DOCUMENTS

| | | |
|---|---|---|
| 410299 | 7/1967 | Australia . |
| 0263379 | 4/1988 | European Pat. Off. . |
| 0327049 | 8/1989 | European Pat. Off. . |
| 0536609 | 4/1993 | European Pat. Off. . |
| 0587238 | 3/1994 | European Pat. Off. . |
| 0587238A1 | 3/1994 | European Pat. Off. . |
| 60-138840 | 7/1985 | Japan . |
| 02160358 | 6/1990 | Japan . |
| 05258722 | 10/1993 | Japan . |

*Primary Examiner*—Vip Patel

*Attorney, Agent, or Firm*—Pearne, Gordon, McCoy & Granger LLP

[57] ABSTRACT

A high pressure discharge lamp utilizing an improved ceramic arctube. The arctube has a ceramic central portion, a first ceramic leg extending from one end of the central portion and in some embodiments a second ceramic leg extending from the other end of the central portion. The arctube has reinforcing means where one or both of the legs joins the central portion to reinforce and strengthen the connection between each leg and the central portion. The reinforcing means is preferably seal glass or a layer of seal glass adjacent a ceramic ring.

20 Claims, 2 Drawing Sheets

ARCTUBE FOR HIGH PRESSURE DISCHARGE LAMP

BACKGROUND OF THE INVENTION

1. Field of the Invention

The present invention relates generally to high pressure discharge lamps and more particularly to an improved strength ceramic arctube for use in a high pressure discharge lamp.

2. Description of Related Art

High pressure discharge lamps, which includes ceramic metal halide, high pressure sodium, and high pressure electrodeless lamps, are well-known and U.S. Pat. Nos. 5,140,227; 4,780,646; 4,409,517; and 3,363,133 are incorporated by reference. It is known in a high pressure metal halide discharge lamp to employ a ceramic arctube which includes a generally-cylindrical ceramic central body, a ceramic plug at each end of the central body, and a ceramic exhaust leg engaging each plug. See, e.g., Eur. Pat. App. EP 0 587 238 A1, the contents of which are incorporated by reference. It has been found that the join or joint between the exhaust leg and the plug is extremely weak, which may lead to failure at the leg, or a leak at the joint that may result in 0 eventual lamp failure.

There is a need for a reinforcement to strengthen the area where the exhaust leg engages the plug of a high pressure discharge lamp, to strengthen the leg and reduce the possibility of lamp failure.

SUMMARY OF THE INVENTION

A ceramic arctube for a high pressure discharge lamp is provided. The arctube includes a ceramic central portion and a first ceramic leg, the ceramic central portion having a first end and a second end, the first ceramic leg extending from said first end. The arctube has reinforcing means where the first leg joins the central portion to reinforce the connection between the leg and the central portion. A high pressure discharge lamp utilizing the ceramic arctube is also provided.

DETAILED DESCRIPTION OF PREFERRED EMBODIMENTS OF THE INVENTION

Percents are weight % unless otherwise indicated or unless the context indicates otherwise. The dimensions of the arctube and its components is after sintering.

Figure 1:
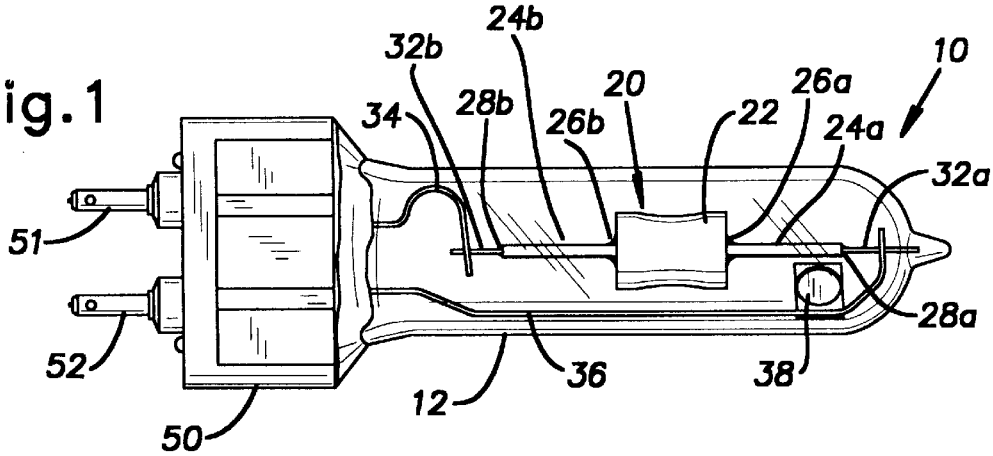
FIG. 1 is a front elevational view of a ceramic metal halide high pressure discharge lamp.

With reference to FIG. 1, there is shown a ceramic metal halide high pressure discharge lamp or ceramic metal halide lamp 10, which is generally known in the art. Lamp 10 has a sealed light-transmissive glass envelope 12, a base 50, electrical connectors 51, 52, and getter 38. Optionally a shroud may be employed. Connectors 51, 52 are connected electrically to electrical conductors 34, 36, respectively, which are connected to electrode assemblies 32*b*, 32*a*, respectively, which terminate in electrodes inside the arctube, as is known in the art. With reference to FIGS. 1–4, there is shown a ceramic arctube 20 which includes a central body 22, end plugs or plugs 23*a*, 23*b*, and legs 24*a*, 24*b*. The central body has a typical exterior diameter (adjacent the end plug) of 6.5–9, less preferably 6–13, less preferably 5–50, mm. The wall of the central body is preferably about 0.75–0.8, less preferably 0.5–1.5, mm thick. Each plug is about 2–3, less preferably 2–5, mm thick. The legs have a typical exterior diameter of about 2–2.5, less preferably 1.5–5, mm, and an inner diameter of about 0.7–0.8, less preferably 0.5–3, mm. The ratio of the exterior diameter of the central body (where it overlays the plug) to the exterior diameter of the leg is preferably about 3.2:1 to about 3.6:1, less preferably about 3:1 to about 4:1, less preferably about 2.5:1 to about 5:1, less preferably about 2.3:1 to about 10:1. These parts are cylindrical and preferably made of polycrystalline alumina, less preferably $Y_2O_3$, yttrium aluminate, mullite, single crystal alumina, spinel, aluminum nitride, aluminum oxynitride ($Al_3O_3N$), or other ceramics known in the art. The parts are put together and sintered at about 1880° C. in a hydrogen atmosphere for about 3 hours to produce the arctube. As shown in FIG. 3, the arctube, including legs, is about 34–38, less preferably about 30–125, mm long. The invented arctubes can be used for lamps having wattages from about 20 to about 1000 watts, more preferably 35–400 watts; the higher the wattage, generally the larger the arctube. As shown in FIGS. 1 and 4, electrode assemblies 40*a*, 40*b* are provided down the center of the legs (thus the legs are adapted to receive a current conductor to provide current to an electrode) and are sealed to the legs at 28*a*, 28*b* and a filling including mercury and metal halides is provided inside the arctube, all as known in the art, for example EP 0 587 238 A1. As shown in FIGS. 3 and 4, there is a recess 27 created by the leg 24*b* not extending all the way to the inner surface or face 41 of plug 23*b*. The electrode may be all or partially in the recess. Alternatively the legs 24*a*, 24*b* may extend to the inner faces of the plugs 23*a*, 23*b*, so that there are no recesses.

In FIGS. 3 and 4, the ceramic central portion of the arctube is the central body 22 in combination with the plugs 23*a* and 23*b*. The legs thus extend from the central portion. Each leg extends from the central portion (from the exterior face of the plug in this case) a distance of preferably at least 2, more preferably at least 3, more preferably at least 4, more preferably about 5–6, times the exterior diameter of the leg, preferably extending about 12–13, less preferably 10–30, mm from the exterior face of the plug.

As shown in FIGS. 3–4, reinforcing means are provided where each leg joins the central portion to reinforce the connection between each leg and the central portion. These connections are already hermetically sealed by the previous sintering operation before any application of reinforcing means. In FIG. 3, the reinforcing means is a seal glass 26*a*, 26*b* which surrounds each leg and which has the appearance of a concave fillet weld and which is formed on the previously-formed arctube as follows. An annular wafer or ring or disk of seal glass, such as Product LS-4C2 from General Electric Company, (preferably about 47% $Al_2O_3$, 38% CaO, 15% BaO) is positioned around the leg adjacent the plug of the sintered arctube and held in place with glue such as polyvinylpyrrolidone or polyvinylalcohol. Preferably oriented horizontally, the assembly is then heated in air at about 1425° C. for 5–10 min. to melt the seal glass, then cooled to about 1275° C. and held for 30 min. (this is for recrystallization of the seal glass). The reinforced assembly is then cooled to room temperature. Recrystallization of the seal glass is important and increases the strength of the reinforcing means.

Alternative compositions of seal glass 26*a,* 26*b* may be used (weight %): 1) 45–50% $Al_2O_3$, 35–40% CaO, 10–20% BaO; 2) the sealant compositions described in U.S. Pat. Nos. 4,076,991; 4,208,605; 5,099,174; and 5,321,335; 3) 44% $Al_2O_3$, 41% CaO, 10% SrO, 5% $Y_2O_3$ (or similar NGK seal glass known in the art); and 4) any high temp. seal glass (and possibly high temp. brazing compounds) which is/are a) suitable for use with alumina and b) suitable for use at temperatures above 900° C.

A less preferred reinforcing means is illustrated in FIG. 4, where an annular seal glass wafer 29*a,* 29*b,* is glued in place adjacent the plug, then an annular wafer or ring or disk of ceramic 30*a,* 30*b,* is glued adjacent the seal glass. Then the heating procedure described above to melt and recrystallize the seal glass is repeated. The seal glass melts and holds the ceramic ring in place. The seal glass and glue to be used are as described for FIG. 3. The ceramic is preferably polycrystalline alumina, less preferably the alternative ceramics described above for the arctube.

As a less preferable alternative to the use of the annular seal glass wafer in the procedures of FIGS. 3 and 4, one may substitute for the seal glass wafer the use of a suspension by heating the base seal glass material to the fusing temperature (1300°–1500° C.), then cool the seal glass and grind it to powder. Then mix with liquid like alcohol (preferred) or acetone or water, then paint or apply the suspension at the joint. Then continue with the procedures described for FIGS. 3 and 4. Alternatively, one may simply mix the precursor oxides, form a suspension, and procede as described above.

Figure 2:
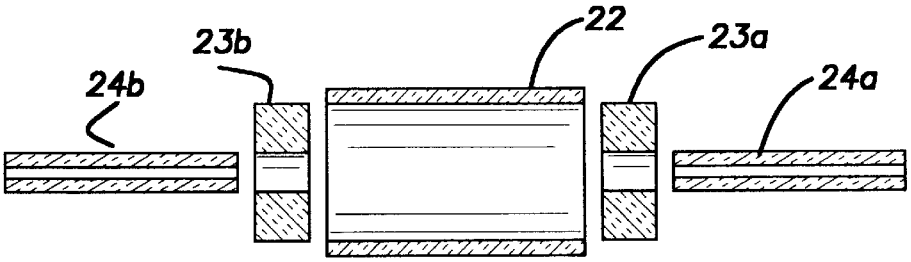
FIG. 2 is an exploded view, in section, of a ceramic arctube before assembly and sintering.
Figure 3:
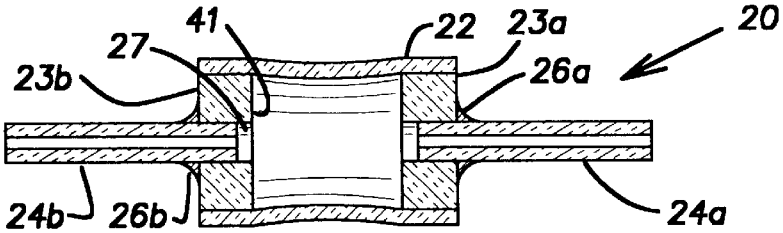
FIG. 3 is a sectional view of a ceramic arctube of the invention.
Figure 4:
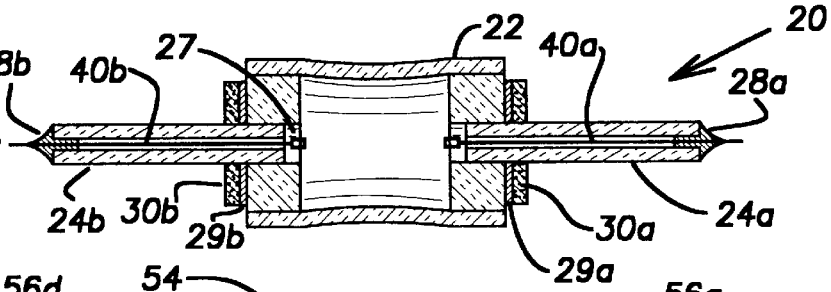
FIG. 4 is a sectional view of an alternative embodiment of a ceramic arctube of the invention, and also including an electrode assembly.
Figure 5:
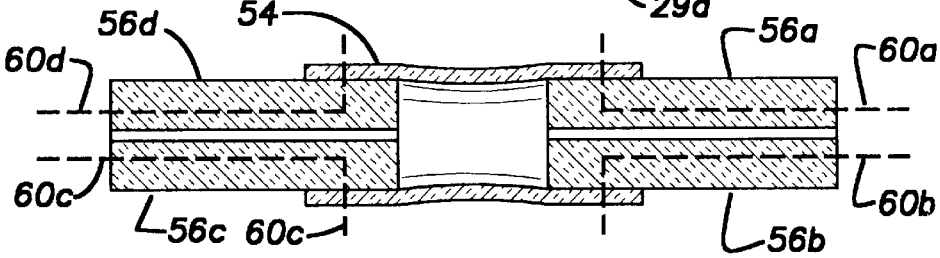
FIG. 5 illustrates, in section, an alternative method of making a ceramic arctube by removing portions denoted by the dashed lines.
Figure 6:
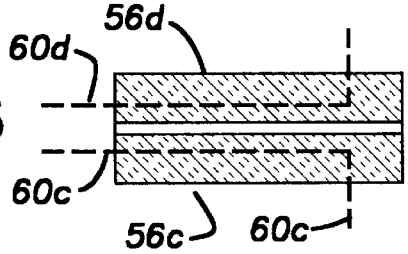
FIG. 6 illustrates, in section, an alternative method of making a portion of a ceramic arctube by removing portions denoted by the dashed lines.

The arctube is shown in FIGS. 2–4 as made from 5 parts or pieces. Less preferably, the arctube can be made from 3 pieces, whereby each leg-plug assembly is from a single piece of ceramic. As shown in FIG. 5, three pieces of ceramic are joined and the portions 56*a,* 56*b,* 56*c,* 56*d* defined by dashed lines 60*a,* 60*b,* 60*c,* 60*d* are cut away to leave the familiar shape of the arctube. Alternatively, as shown in FIG. 6, the leg-plug assembly can be made from a single piece by removing portions 56*c,* 56*d.* Less preferably the leg-plug assembly can be molded such as by injection molding. In all of these embodiments where the leg-plug assembly is an integral piece of ceramic, the reinforcing means of the invention may still be added thereto and utilized and the benefits of the invention realized.

Figure 7:
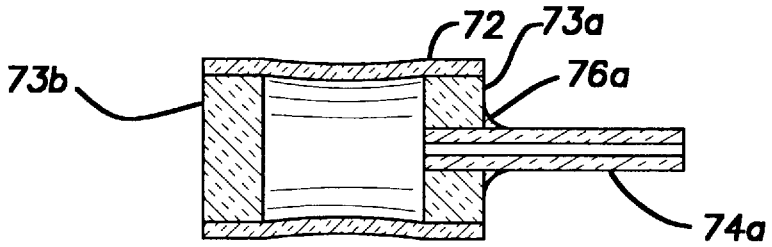
FIG. 7 is a sectional view of a ceramic arctube of the invention, before it is sealed, having a single leg for use as an electrodeless ceramic arctube.

All of the foregoing features can also be incorporated in an electrodeless ceramic arctube, such as illustrated in FIG. 7, for use in a high pressure electrodeless lamp. In FIG. 7 there is a central body 72, a solid end plug 73*b,* an end plug 73*a,* a leg 74*a* (preferably 60–90 mm long, measured from the external face of the end plug 73*a*), and seal glass 76*a,* before the arctube is sealed; the ceramic central portion is the central body 72 and the end plugs 73*b* and 73*a*. Other reinforcing means described above may also be used. The arctube of FIG. 7 is made as described above and otherwise as known in the art.

EXAMPLES

A number of 70 W ceramic metal halide arctubes (as in FIG. 3) were made of polycrystalline alumina generally as described above, with and without reinforcing means, the reinforcing means being seal glass (General Electric Product LS-4C2)as illustrated in FIG. 3. Strength of the leg-plug joint was determined using an Instron testing machine. A fixture was set up that held the body and a load was applied at 10 mm from the body on an individual leg. The loads at failure (in lbs) were as follows.

| | Average | Standard Deviation |
|---|---|---|
| 1. Arctubes without reinforcing means. | 4.4 | ±0.4 |
| 2. Arctubes with reinforcing means. | 12.2 | ±1.8 |

The arctubes without reinforcing means failed where the leg entered the plug; those with reinforcing means failed along the leg about 2 mm from the leg-plug joint. This infers an even greater load would be required to cause failure at the leg-plug joint with the reinforcing means present.

70 W ceramic metal halide lamps were made with and without the seal glass reinforcing means described in the preceding paragraph. Lamps were operated to approx. 500 hours. Stresses during operation of the lamps can cause the monolithic join or joint along the leg-plug interface to open and the lamp to fail. 16% (3 of 19) of the lamps without the reinforcing means failed; 0% (0 of 29) of the lamps with the reinforcing means failed. The results of the testing and the dramatic benefits of the invention were surprising and unexpected.

Although the preferred embodiments of the invention have been shown and described, it should be understood that various modifications and rearrangements may be resorted to without departing from the scope of the invention as disclosed and claimed herein.

What is claimed is:

1. A ceramic arctube for a high pressure discharge lamp comprising a ceramic central portion and a first ceramic leg, said ceramic central portion having a first end and a second end, said first ceramic leg extending from said first end, said arctube having reinforcing means where said first leg joins said central portion to reinforce the connection between said leg and said central portion, said central portion having an exterior diameter adjacent said first end, said first leg having an exterior diameter, the ratio of said central portion exterior diameter to said first leg exterior diameter being between about 2.3:1 and about 10:1, said reinforcing means being nonintegrally formed with said central portion.

2. An arctube according to claim 1, further comprising a second ceramic leg extending from said second end, each of said first and second legs being adapted to receive a current conductor to provide current to an electrode, said arctube having reinforcing means where each of said first and second legs joins said central portion, each of said reinforcing means being nonintegrally formed with said central portion.

3. An arctube according to claim 2, wherein said reinforcing means is seal glass surrounding each of said first and second legs.

4. An arctube according to claim 3, wherein said reinforcing means has a shape of a fillet weld.

5. An arctube according to claim 2, wherein each of said reinforcing means is a layer of seal glass adjacent a ceramic ring, said seal glass and said ceramic ring surrounding each of said first leg and said second leg adjacent said central portion.

6. An arctube according to claim 1, wherein said ratio is between about 3:1 and about 4:1.

7. An arctube according to claim 1, wherein said ratio is between about 3.2:1 and about 3.6:1.

8. An arctube according to claim 1, wherein said ratio is between about 2.5:1 and about 5:1.

9. A high pressure discharge lamp comprising a sealed light-transmissive envelope and a ceramic arctube positioned within said envelope, said arctube comprising a ceramic central portion and a first ceramic leg, said central portion having a first end and a second end, said first leg extending from said first end, said arctube having reinforcing means where said first leg joins said central portion to reinforce the connection between said leg and said central portion, said central portion having an exterior diameter adjacent said first end, said first leg having an exterior diameter, the ratio of said central portion exterior diameter to said first leg exterior diameter being between about 2.3:1 and about 10:1, said reinforcing means being nonintegrally formed with said central portion.

10. A lamp according to claim 9, further comprising a second ceramic leg extending from said second end, said arctube having reinforcing means where each of said first and second legs joins said central portion, each of said reinforcing means being nonintegrally formed with said central portion.

11. A lamp according to claim 10, wherein said reinforcing means is seal glass surrounding each of said first and second legs.

12. A lamp according to claim 10, wherein each of said reinforcing means is a layer of seal glass adjacent a ceramic ring, said seal glass and said ceramic ring surrounding each of said first leg and said second leg adjacent said central portion.

13. A lamp according to claim 9, wherein said reinforcing means is seal glass surrounding said first leg.

14. A lamp according to claim 13, wherein said reinforcing means has a shape of a fillet weld.

15. A lamp according to claim 9, wherein said ratio is between about 3:1 and about 4:1.

16. A lamp according to claim 9, wherein said lamp is a ceramic metal halide lamp.

17. A lamp according to claim 9, wherein said lamp is a high pressure sodium lamp.

18. A lamp according to claim 9, wherein said lamp is an electrodeless lamp.

19. A lamp according to claim 9, wherein said ratio is between about 3.2:1 and about 3.6:1.

20. A lamp according to claim 9, wherein said ratio is between about 2.5:1 and about 5:1.

* * * * *

UNITED STATES PATENT AND TRADEMARK OFFICE

CERTIFICATE OF CORRECTION

PATENT NO. : 5,866,982

DATED : February 2, 1999

INVENTOR(S) : Curtis E. Scott, et al.

It is certified that error appears in the above-identified patent and that said Letters Patent is hereby corrected as shown below: On the title page:

, under [56] References Cited, U.S. Patent Documents, please add the following:

| | | | |
|---|---|---|---|
| 4,539,511 | 9/1985 | Denbigh, et al. | 313/634 |
| 4,691,141 | 9/1987 | Buhrer, et al. | 313/623 |
| 4,765,820 | 8/1988 | Naganawa, et al. | 313/634 |
| 4,988,916 | 1/1991 | Odell, et al | 313/623 |
| 5,208,509 | 5/1993 | Snellgrove, et al. | 313/634 |
| 5,424,609 | 6/1995 | Geven, et al. | 313/634 |

Column 1, line 24, after "in" delete --0--.

Column 3, line 66, "70 W" should be --70W--.

Column 4, line 20, "70 W" should be --70W--.

Signed and Sealed this

Twenty-third Day of May, 2000

*Attest:*

*Attesting Officer*

Q. TODD DICKINSON

*Director of Patents and Trademarks*